United States Patent [19]

McKay

[11] 4,156,957

[45] Jun. 5, 1979

[54] PROCESS FOR PRODUCING MATT SURFACED HIGHLY, FIBRILLATED WOVEN SYNTHETIC FABRIC

[75] Inventor: Alexander D. D. McKay, Dundee, Scotland

[73] Assignee: Synthetic Fabrics (Scotland) Limited, Forfar, Scotland

[21] Appl. No.: 787,799

[22] Filed: Apr. 15, 1977

[30] Foreign Application Priority Data

| | | | |
|---|---|---|---|
| Apr. 22, 1976 | [GB] | United Kingdom | 16342/76 |
| Nov. 2, 1976 | [GB] | United Kingdom | 45528/76 |
| Nov. 3, 1976 | [GB] | United Kingdom | 45727/76 |

[51] Int. Cl.[2] ..... D05C 15/04; D06C 19/00

[52] U.S. Cl. ..... 28/159; 28/112; 28/115; 28/163; 28/169; 112/410; 428/226; 428/234

[58] Field of Search ..... 28/72.2 R, 163, 165, 28/170, 107, 112, 115, 169; 264/78; 112/410, 411; 156/148; 428/226, 234

[56] References Cited

U.S. PATENT DOCUMENTS

| | | | |
|---|---|---|---|
| 2,991,537 | 7/1961 | Moler et al. | 28/165 X |
| 3,369,435 | 2/1968 | Boultinghouse | 28/107 X |
| 3,428,506 | 2/1969 | Johnstone | 428/234 X |
| 3,536,673 | 10/1970 | Parrini | 264/78 |
| 3,542,632 | 11/1970 | Eickhoff | 28/72.2 R X |
| 3,565,308 | 2/1971 | Slack | 28/170 X |
| 3,637,905 | 1/1972 | Ager | 264/78 X |
| 3,874,965 | 4/1975 | Greenwald et al. | 156/148 X |

FOREIGN PATENT DOCUMENTS

| | | | |
|---|---|---|---|
| 1224022 | 3/1971 | United Kingdom | 112/410 |

*Primary Examiner*—Robert Mackey

*Attorney, Agent, or Firm*—Bacon & Thomas

[57] ABSTRACT

A woven fabric made from flat warp and weft tapes of polypropylene, such as is currently used as a primary carpet backing, is subjected to a repeated needling operation which breaks down each warp and weft component into a multiplicity of fibrils. This fibrillation of the warp and weft in the woven fabric produces a marked change in the surface of the fabric from a relatively shiny to a relatively matt finish. The fibrillated fabric may be rendered dyeable to a good coloration (similar to the color of dyed face yarns of a carpet) either by including a dyeable material in with the polypropylene from which the tapes are originally formed, or by adhering a dyeable coating to the fibrillated fabric. Further repetition of the needling operation reduces the denier of the fibrils still more and produces a generally softer fabric.

9 Claims, 7 Drawing Figures

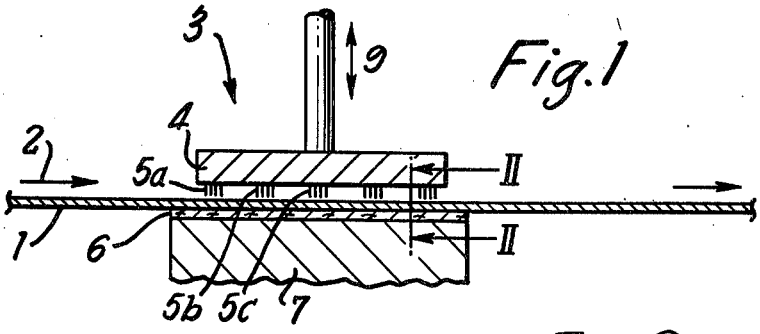
Fig. 1
Fig. 2
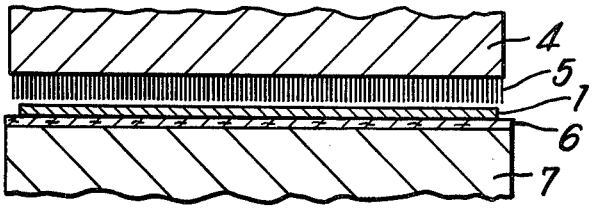
Fig. 4
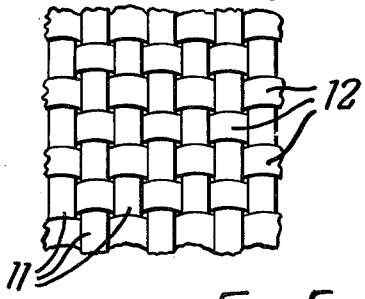
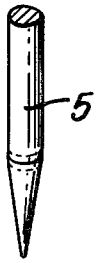
Fig. 3
Fig. 5
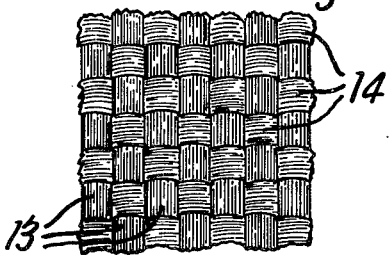

Fig. 6
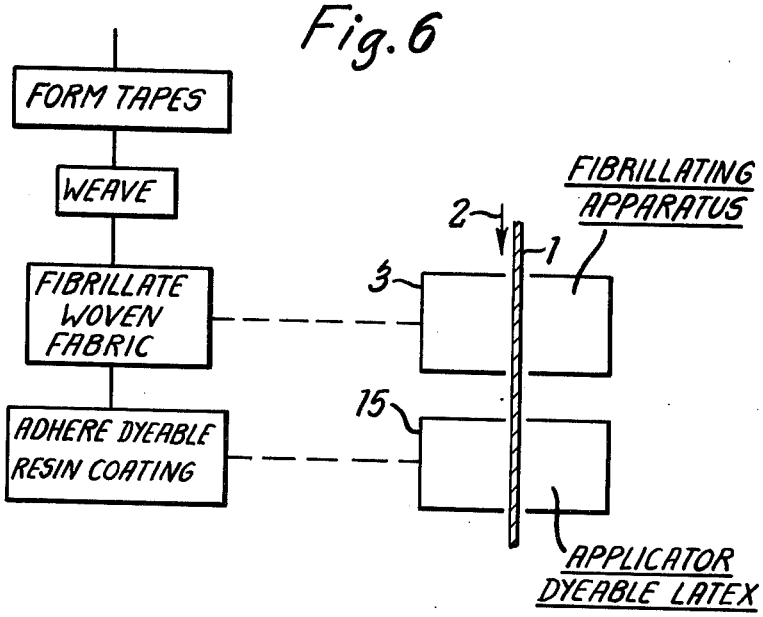
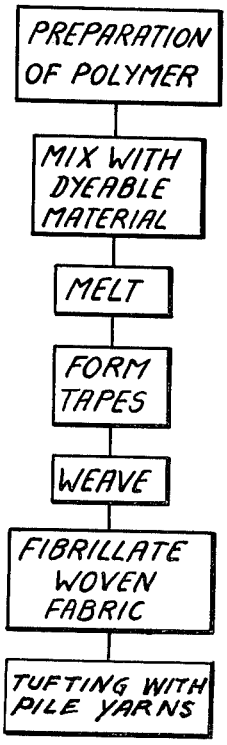
Fig. 7

PROCESS FOR PRODUCING MATT SURFACED HIGHLY, FIBRILLATED WOVEN SYNTHETIC FABRIC

BACKGROUND OF THE INVENTION

This invention relates to woven fabrics in which the warp and weft are made of synthetic resinous material. One particular example of such a woven fabric is that which is intended for use as a carpet backing and which is formed from flat warp and weft tapes of synthetic resinous material, for example, polypropylene.

When a woven fabric is said to be formed from "warp and weft tapes", this is to be understood as meaning that the tapes have a cross-section in which the maximum dimension or width is substantially greater than the greatest thickness. Commonly, the warp and weft tapes are obtained by individual extrusion or by slitting an extruded film of the synthetic resinous material. When the expression "warp and weft tapes" is used, it is not intended to convey any particular state of either in respect of twisting and/or folding. When a woven fabric is said to be formed from "flat warp and weft tapes", this is intended to convey that the tapes are substantially twistless in the woven fabric and present a flat appearance. However, in a woven fabric which is said to be formed from flat warp and weft tapes, there is usually an incidence of twist or folding present, particularly in the case of the weft.

SUMMARY OF THE INVENTION

In accordance with the present invention there is provided a woven fabric having warp and weft of synthetic resinous material, the woven material having been treated to break down the warp and weft into a multiplicity of fibrils.

When it is said that the warp and weft in the woven fabric are broken down into a multiplicity of fibrils, it is meant that any cross-section through a treated warp or weft is also a cross-section through a multiplicity of fibrils. The synthetic resinous elements which constitute the warp and the weft of the woven fabric are caused to accept a multiplicity of longitudinal splits, such that each warp and weft is changed from an element having a continuous surface into a member which comprises fibrils which in general are joined together in the form of a random network. The process which effects this change is a fibrillating process which causes the appearance of the surfaces of the warp and weft components of the woven fabric to be changed from a continuous and shiny surface to a matt appearance. Consequently, the woven fabric which has its warp and weft broken down into a multiplicity of fibrils in accordance with the present invention has a markedly different reflective property in its surface as compared with the woven fabric before the treatment to produce the fibrils. The woven fabric after treatment has a relatively matt surface in contrast to the generally reflective nature of the surface before the treatment.

A woven fabric in accordance with the present invention preferably has the warp and weft formed of flat warp and weft tapes which are broken down into a multiplicity of fibrils.

The fibrillation of the flat warp and weft tapes of synthetic resinous material in the woven fabric has the effect that the fibrils comprising the warp and weft in the fibrillated woven fabric are not bunched together so that each warp or weft has a circular or oval cross-section as would tend to happen if the fabric were woven using fibrillated components. By contrast, the fibrils comprising the warp and weft in a woven fabric in accordance with the present invention give the visual appearance of lying side by side, and the warp or weft or both frequently have a greater width than the tapes from which they were derived. Each warp and weft may be said to be comprised of a flat bundle of fibrils, that is to say the bundle of fibrils taken together defines an essentially flat component for the warp or weft rather than a warp or weft component of circular or oval cross-section. Inevitably, however, the individual fibrils in each flat bundle of fibrils do not all lie in one plane.

Fibrillation in situ has the effect of spreading the fibrillated tapes and making cloth cover more uniform, where the original cloth construction permits this.

Advantageously, the warp and weft of a woven fabric in accordance with the present invention are fibrillated by repeated needling thereof.

The repeated needling of the woven fabric which effects fibrillation of the warp and weft in accordance with the present invention is an operation in which the woven fabric is subjected to a very large number of needle penetrations. In order to effect a fibrillation which causes a significant decrease in the reflective power of the surface of the woven fabric, it is believed that each square centimeter of the woven fabric should be subjected to at least 800 needle penetrations. Preferably each square centimeter of the woven fabric is subjected to at least 1,800 needle penetrations, and in the embodiment of the present invention which will be described, each square centimeter of the woven fabric composed of warp and weft elements of synthetic resinous material will be subjected to approximately 3,000 needle penetrations.

Advantageously, the fibrillation of the warp and weft elements in the woven fabric is effected by a repeated needling of the woven fabric using needles of circular cross-section. The needles used in the needling operation in accordance with the present invention are to be contrasted with the needles used in the conventional needle loom which are of triangular cross-section.

Although the splitting of the individual warp and weft elements is effected in the preferred embodiment of the present invention using such needles of circular cross-section, it is envisaged that the fibrillation of these elements may be effected by repeated needling of the woven fabric using needles of other cross-section, provided that these are smooth or rounded cross-section, i.e. provided that the peripheries of the needles do not include discontinuities in direction such as are present, for example, in a needle of triangular cross-section.

By the use of needles of smooth or rounded cross-section, any substantial lateral cutting of the warp and weft is avoided and a matt surface is produced which is relatively free of surface hairiness.

Advantageously in carrying out the invention, a needle density over at least part of the needle board of the order of 100 to 150 needles per square centimeter is provided. It is believed that, compared with conventional needle loom practice where densities up to about 2 per square centimeter are used, a density of a much higher order is required.

The degree and form of the increase in effective width of warp and weft elements as a result of fibrillation by needling in the manner described are influenced by the initial construction of the woven fabric.

The closer the construction of woven fabric used, the more restricted will the increase in width become. In most constructions of woven fabric, the increase in effective width of the warp, is more or less restricted to the lengths passing over the individual weft elements.

Advantageously, a woven fabric in accordance with the present invention is made from a synthetic resinous material which has a dyeable component incorporated therein. When such a woven fabric is dyed with an appropriate dyestuff, it is found to exhibit substantially more coloration than a woven fabric which comprises tapes of the same synthetic resinous material (for example, polypropylene) incorporating the same quantity of dyeable component when subjected to the same treatment with dyestuff.

A woven fabric in accordance with the present invention may have a coating material (for example, a latex material) adhered thereto. The adherence of a coating material may be for the purpose of rendering the woven fabric dimensionally stable. It is found that adhesion of a coating material to a woven fabric in accordance with the present invention is much more readily obtained than with a woven fabric having warp and weft elements of unfibrillated, extruded, synthetic resinous material. It is believed that the improved adhesion arises from the presence in the woven fabric in accordance with the present invention of a multiplicity of edge surfaces presented by the fibrils.

By adhering a dyeable material to a woven fabric in accordance with the present invention, the woven fabric may be rendered more readily dyeable. Conveniently, the dyeable material which is adhered to a woven fabric in accordance with the present invention is an acid-dyeable resin.

A woven fabric in accordance with the present invention may be subjected to further fibrillation by repeated needling. In such event, the fibril denier will be further reduced, and the shape of many of the fibrils altered from rectangular by the elimination of some of the corners. This will result, as needling is increased, in a softer fabric, which will be more akin to the feel and handle of fibrous fabrics.

A woven fabric in accordance with the present invention is capable of many uses, for example, as a carpet backing, an industrial fabric, as a furnishing fabric, as a wall fabric, as an awning, and as one element of a laminate.

Because of the improved ability of the woven fabric to adhere to other materials, the woven fabric in accordance with the present invention has particular advantageous use as a secondary carpet backing. However, the woven fabric in accordance with the present invention provides a substantial number of advantages when used as a primary carpet backing in the production of tufted carpets.

Conventional woven carpet backing is composed of warp and weft tapes of polypropylene which have a rectangular cross-section. Such a backing inevitably presents an uneven surface to the tufting needle. Consequently the location of the tufting yarn in the woven backing materials is liable to variation with the result that the surface of the pile in a tufted carpet made from a woven carpet backing is subjected to irregularity. These are other disadvantages in the use of a woven carpet backing made from synthetic resin tapes. For example, the constituent tapes are liable to be displaced by the tufting needle (a feature known and hereafter referred to as 'needle deflection') and this gives rise to an irregular tufting pattern in the final carpet. Also, the backing shows little or no response to the dyestuffs appropriate to the most common materials (notably polyamides) used in the tufting operation to form the pile of the carpet. This failure and the shiny surface of conventional woven carpet backings can lead to a phenomenon known as 'grinning' in which the backing shows up through the tufts, particularly when the carpet is bent and the tufts splay apart.

These last disadvantages have proved so serious in some cases that an overlay of fibers has been needled into the carpet backing in order to cover the surface of the backing before the backing is tufted to produce the carpet. Such a product provides that, in the event of the tufts splaying apart, it is the overlay of fibers which is seen through the tufts, and there is no light reflection from the backing itself. Also, the overlay of fibers may be dyed to a colour similar to the colour of the tufting yarns. However, it will be appreciated that the introduction of a fiber overlay as a preliminary to the tufting operation increases the cost of the carpet backing.

The use of a woven fabric in accordance with the present invention provides a significant improvement when used as a carpet backing, in that its surface is relatively matt compared with the surface of the presently used woven carpet backings which have no overlay. It is also found that the woven fabric in accordance with the present invention may be rendered relatively dyeable by the dyestuffs commonly used to dye the face yarns of the carpet.

A further advantage of a woven fabric in accordance with the present invention when used as a primary carpet backing is that the incidence of needle deflection is greatly reduced.

Accordingly, in accordance with the present invention there is provided a carpet including a carpet backing material which is a woven fabric in accordance with the present invention having pile yarns tufted therethrough.

Further in accordance with the present invention there is provided a method of manufacturing a woven material which includes the step, after weaving a woven fabric having warp and weft tapes of synthetic resinous material, of fibrillating the warp and weft tapes.

Advantageously the product in accordance with the present invention is prepared using apparatus which comprises a needle board, a multiplicity of needles of generally rounded cross-section mounted on the needle board with the tips of the needles all in substantially the same plane and arranged at a density of at least 75 needles per square centimeter over at least a part of the surface of the needle board, means for reciprocating the needle board such that the needles are moved axially, and a support capable of maintaining a woven fabric in a substantially planar configuration during reciprocation of the needle board such that the needles penetrate the warp and weft of the woven fabric, the support accomodating, without damage to the needles, the tips of the needles which penetrate the woven fabric.

Preferably, the needles are mounted on the needle board in a density of the order of 120 per square centimeter over at least a part of the area of the needle board.

In the embodiments of the apparatus according to the present invention which will be described, the support comprises a base having thereon a covering of chromed leather. However, a flocked fabric may also be used as the covering to the base.

Advantageously, the apparatus is so arranged and constructed that the needle board is vertically reciprocated sufficient times for each square centimeter of the woven fabric to be subjected to about 3,000 penetrations.

BRIEF DESCRIPTION OF THE DRAWINGS

The present invention will be better understood from the following detailed description which is given, by way of example, with reference to the accompanying diagrammatic drawings, in which:

FIG. 1 is a side view of apparatus for treating a woven fabric of flat warp and weft tapes of polypropylene, FIG. 2 is an enlarged cross-sectional view of a part of the apparatus of FIG. 1 taken along the line II—II of FIG. 1, FIG. 3 is a greatly enlarged perspective view of a needle used in the apparatus of FIG. 1, FIG. 4 is a greatly enlarged plan view of a woven fabric comprising polypropylene tapes before treatment in accordance with the present invention, FIG. 5 is a similar view of the same woven fabric following treatment using the apparatus of FIGS. 1 to 3, and FIGS. 6 and 7 are schematic flow diagrams showing the steps of alternative processes of making woven fabrics in accordance with the present invention.

In the drawings the same or similar parts are designated by like reference numerals.

DETAILED DESCRIPTION

Referring to the drawings, there is shown in FIG. 1 a woven fabric 1 which is formed from flat warp and weft tapes, both composed of a synthetic resinous material. Conveniently, both the warp and weft tapes are polypropylene tapes of rectangular cross-section, the weft tapes, for example, having a width of the order of two and a half milimeters while the warp tapes have a width of the order of one and a quarter millimeters. The woven fabric 1 is advanced in the direction of an arrow 2 towards a fibrillating apparatus 3.

During its advance in the direction of the arrow 2, the woven fabric 1 (which may have a suitable lubricant applied to it) is passed through the fibrillating apparatus 3 which may be generically described as a needling machine. The fibrillating apparatus 3 is however different from a conventional needle loom in that it has a special needle board 4 and also a special support which supports the woven fabric 1 during operating of the needle board 4.

The needle board 4 carries needles 5 of circular cross-section, which are fine needles arranged on the needle board in dense groups 5*a*, 5*b*, 5*c* etc. (see FIG. 1). Each group of the needles 5 contains four strips of needles 5 extending laterally across the width of the fibrillating apparatus 3, as shown in FIG. 2, the needles in each strip being a row containing approximately 16 needles to each centimeter length of the strip. The overall width of each group 5*a*, 5*b*, 5*c* etc. of needles is approximately 5 millimeters, with the result that each area of the needle board 4 which carries a group of needles 5*a*, 5*b*, 5*c* etc. has the needles mounted in a density of the order of 120 per square centimeter. There is a spacing of the order of 10 millimeters between the separate groups 5*a*, 5*b*, 5*c* etc. of needles.

As the woven fabric 1 is passed through the fibrillating apparatus 3 it is supported by a surface covering 6 on a solid base or bed 7.

The surface covering 6 used on the bed 7 is advantageously chromed leather. When leather is used, the needle board 4 is preferably reciprocated to cause the needles 5 to perforate the surface of the leather covering on the bed 7 in the absence of any woven fabric 1, thereby forming in the surface of the leather minute holes for receiving the tips of the needles 5 while the remainder of the surface of the leather provides a close support for the woven fabric 1 around the areas where the needles 5 impact the woven fabric 1.

As the woven fabric 1 advances in a step by step manner through the fibrillating apparatus 3, the needle board 4 is reciprocated at a sufficient rate to impart 3,000 needle penetrations per square centimeter.

In FIG. 3, there is illustrated one of the needles 5 which are mounted densely on areas of the needle board 4 as illustrated in FIGS. 1 and 2. The needle 5 has a circular cross-section.

In operation of the fibrillating apparatus 3, at least the tips of the needles 5 are required to penetrate through the woven fabric 1.

Variations in the finish produced by treatment of a woven fabric by the method of the present invention may be achieved by adjusting the degree of penetration of the needle tips and the density of needling. The density of needling is affected by the density with which the needles are mounted in the apparatus, and by the rate at which the woven fabric is advanced through the apparatus in conjunction with the speed at which the needles are reciprocated by the apparatus.

The effect of repeated penetration of the warp and weft tapes making up the woven fabric 1 by the needles 5 is to make a large number of splits in each warp and weft tape so that, at any cross-section through a warp or a weft tape, it is comprised of a multiplicity of fibrils. The consequence is that the shiny surfaces which were present in the warp and weft tapes as the woven fabric 1 approached the fibrillating apparatus 3 are replaced by a broken-up surface, consisting of a multiplicity of fibrils so that the warp and weft components of the woven fabric are composed of fibrils. The effect of the breaking-up of the surfaces of the warp and weft tapes by the fibrillating apparatus 3 is that the degree of reflectivity in the woven fabric 1 emerging from the fibrillating apparatus 3 is substantially reduced as compared with its reflectivity before treatment in the fibrillating apparatus 3.

The woven fabric 1 which has been treated in the fibrillating apparatus 3 in accordance with the present invention has a relatively matt surface as a result of the woven fabric being composed of warp and weft, each of which has been obtained by fibrillating a warp or weft tape in situ in the woven fabric. Each warp or weft therefore comprises a multiplicity of fibrils, which constitute a flat bundle, giving a visual impression that the fibrils lie substantially in the same plane.

The fibrillation of the warp and weft tapes of the woven fabric 1 by the action of the fibrillating apparatus 3, has the effect of causing the warp and weft to tend to spread so that, if such spreading is possible, the fibrils which comprise each of the warp and weft after the fibrillating treatment have a greater combined width than the respective tape prior to the fibrillation treatment. This spreading of the warp and weft elements of the woven fabric 1 in the fibrillation treatment is believed to be facilitated by causing more than the tips of the needles 5 to penetrate the tapes of the woven fabric.

FIGS. 4 and 5 of the accompanying drawings illustrate the surface appearance of the woven fabric 1 before and after the treatment in a fibrillating apparatus 3.

Referring to FIG. 4, there are shown warp tapes 11 and weft tapes 12 each formed from polypropylene. The surfaces of the tapes 11 and 12 which are exposed in the woven fabric 1 are smooth and shiny as a result of the tapes being derived from an extruded film of polypropylene. It will also be observed in FIG. 4 that there tend to be spaces between the warp tapes 11 and the weft tapes 12.

Referring now to FIG. 5, the woven fabric after the treatment by the fibrillating apparatus 3 has individual warp and weft 13 and 14 comprised of a multiplicity of fibrils which give the woven fabric of FIG. 5 the appearance of a basket-weave. The breaking down of each tape 11 and 12 by splitting into a multiplicity of fibrils causes the surface of the woven fabric of FIG. 5 to be relatively matt as compared with the surface of the woven fabric of FIG. 4. Also the splitting of the individual warp tapes 11 and weft tapes 12, each into a multiplicity of fibrils, causes both to spread with the result that any gaps which previously existed between edges of the warp and weft components of the woven fabric 1 are substantially reduced.

In general, the breaking-down of the warp tapes 11 and weft tapes 12 into the multiplicity of fibrils which comprise the warp 13 and weft 14 will cause the resultant warp and weft components to have a greater width than the original tapes as described above, at least where the warp and weft constitute the exposed surface of the woven fabric 1, e.g. where a warp is supported by a weft. However, the ability of the warp and weft to spread may be restricted in fabrics which have a close initial construction.

The treatment in accordance with the present invention to break down each warp and weft into a multiplicity of fibrils may be effected with a lesser number of needle penetrations than 3,000 per square centimeter.

There will now be given examples of woven fabrics which are treated by fibrillating warp and weft tapes in situ in the woven fabric.

EXAMPLE 1

A woven fabric was formed from warp and weft tapes of polypropylene which were both of generally rectangular cross-section. The warp tapes, drawn at a draw ratio of 6:1, were approximately one and a quarter millimeters in width, the weft tapes, drawn at a draw ratio of 7:1, had a width of approximately two and a half millimeters, and both warp and weft tapes had a thickness of the order of 50 microns, the warp tapes being approximately 500 denier and the weft tapes being approximately 1,000 denier. In the woven fabric formed from these warp and weft tapes, there were 94 warp ends per 10 centimeters and 51 weft ends per 10 centimeters.

Each square centimeter of this woven fabric was subjected to about 3,000 needle penetrations using the fibrillating apparatus 3 described above with reference to FIGS. 1 to 3 of the drawings. The resultant product is a woven fabric having warp and weft each comprised by a flat bundle of fibrils, the individual fibrils being generally rectangular in cross-section. The warp components are comprised of fibrils of 40 denier average with a range from 13 to 70 denier, while the weft components are comprised of fibrils of 27 denier average with a range from 8 to 50 denier.

EXAMPLE 2

The fibrillated woven fabric which is the product of Example 1 was passed through the fibrillating apparatus 3 in similar manner on two further occasions. The resulting woven fabric, which had been subjected to about 10,000 needle penetrations per square centimeter, was a markedly softer cloth than the product of Example 1.

Examination of the woven fabric which had been subjected to about 10,000 needle penetrations per square centimeter showed that a change in the shape of the fibrils in this cloth had occurred as compared with the product of Example 1. The product of this present example was a woven fabric composed of fibrils having a lower average denier and many of the fibrils had portions which were no longer rectangular in cross-section due to corners having been removed.

The fibrils of the warp components of the woven fabric resulting from 9,000 needle penetrations per square centimeter were on average of 18 denier and ranged from 6 to 35 denier. The fibrils of the weft components were on average of 11 denier and ranged between 7 denier and 18 denier.

EXAMPLE 3

Subjection of the product of Example 2 to two further passes through the fibrillating apparatus 3 so that each square centimeter of the woven fabric was subjected to approximately 15,000 needle penetrations produced a further softening in the resulting product.

EXAMPLE 4

Polypropylene tapes of approximately 1,000 denier were used as both warp and weft in the weaving of a woven fabric having 39 warp ends per 10 centimeters and 51 weft ends per 10 centimeters. This woven fabric was then fibrillated using the fibrillating apparatus 3 described above in order to subject each square centimeter of the woven fabric to about 10,000 needle penetrations.

The products of Examples 2 and 3 are woven fabrics based on synthetic resinous material (polypropylene) which have been obtained by a process which is substantially cheaper than the known conventional methods of producing a cloth of similar handle and properties from synthetic fibers. The product of Example 4 which is a woven fabric obtained by weaving tapes of 1,000 denier polypropylene, with 39 warp ends per 10 centimeters and 51 weft ends per 10 centimeters followed by the fibrillating treatment of the present invention is a cheaper manufacturing process than that of weaving from synthetic fibers a fabric having, for instance, some 200 or 250 warp and weft ends per 10 centimeters.

The woven fabric of Example 1 above and which has the form illustrated in FIG. 5 possesses a substantial advantage with regard to the adhesion to it of material such as a latex. It is known to attach to a woven fabric such as that illustrated in FIG. 4, when intended for use as a conventional carpet backing material, a coating or layer of latex in order to give the woven fabric a resistance to distortion, that is to say a resistance to deformation of the woven fabric from an overall rectangular shape towards a parallelogram or diamond shape. However, polypropylene is an hydrophobic material, and the surfaces of the polypropylene tapes which comprise the warp tapes 11 and the weft tapes 12 do not readily adhere to an adhesive material such as latex. Accordingly, a coating of latex is secured to the woven fabric of FIG. 4 by a mechanical interlocking or keying of the latex into the gaps between the warp and weft tapes of polypropylene, and in order to obtain this mechanical keying of the latex to the fabric a relatively thick coating of latex is necessary.

However, the product of Example 1 and FIG. 5 has a much greater facility for adhering a coating, for example a latex, to the woven fabric. The fibrils in the warp and weft 13 and 14 present many more exposed edges for latex adhesion, and in consequence a layer or coating of latex may be applied to the woven fabric of FIG. 5, with a much lesser thickness than is necessary in order to secure a latex covering to the woven fabric of FIG. 4. It has also been found that a more uniform spreading of the latex can be achieved.

This has a significant advantage in economy in the quantity of latex used. There is a further advantage in that the thinner layer of latex which may be used to prevent mechanical distortion of the woven fabric of FIG. 5 may be pierced relatively easily by a tufting needle when the woven fabric is used as a carpet backing material. This is in contrast to the difficulty which the tufting needle has in piercing the woven fabric of FIG. 4, which requires the substantially thicker coating of latex in order to obtain adherence between the latex and the fabric, with the result that the tufting needle is liable to punch holes in the fabric, and thereby damage the backing material.

A further and very important advantage which is provided by the woven fabric of FIG. 5 is the ability to impart color to a woven fabric based on polypropylene. Hitherto it has been one of the major disadvantages of woven fabrics based on polypropylene, when used as carpet backings, that they have a poor dye characteristic and in consequence the backing material is particularly likely to show up through dyed yarns which constitute the pile of the carpet. The present applicant has found that the woven fabric treated in the manner described in accordance with the present invention, and as illustrated in FIG. 5, may be readily rendered dyeable by appropriate dyestuffs. This is achieved by applying to the woven fabric of FIG. 5 a latex which has the ability to be dyed. Latex having the ability to be dyed, for instance by an acid dyestuff (hereinafter referred to as "acid-dyeable latex"), is obtainable, for example, from Rohm & Haas. The latex is applied to the woven fabric of FIG. 5 by any suitable method, for example, by spraying or by using a doctor blade or by passage of the woven fabric in contact with the upper surface of a roller, the lower surface of which is passing through a bath of the dyeable latex. An applicator 15 for applying the dyeable latex is shown diagrammatically in FIG. 6, which is a flow diagram illustrating this aspect of the present invention.

The applicant has made comparative tests in which similar quantities of acid-dyeable latex have been applied to the woven fabrics of FIGS. 4 and 5. These tests have shown that, when the two woven fabrics, each carrying similar layers of acid-dyeable latex, are treated in a bath of acid dyestuff, the woven fabric of FIG. 4 shows little overall coloration, whereas a significant and uniform depth of color appears in the latex-coated woven fabric of FIG. 5. Good coloration of the woven fabric of FIG. 5 has been obtained with an addition of only about 12½% by weight of the acid-dyeable latex. Accordingly, the woven fabric of FIG. 5 with the acid-dyeable latex is suitable for use as a primary backing for tufted carpets of which the pile is a material such as polyamide which is subsequently dyed using an acid dyestuff.

Examination of the woven fabric of FIG. 4 after treatment with an acid dyestuff shows that such coloration as is present occurs principally at the edges of the polypropylene tapes which comprise the warp tapes 11 and the weft tapes 12. It is believed that the very marked improvement in coloration which occurs as a result of the acid dye treatment of the woven fabric of FIG. 5 after coating with acid-dyeable latex is a consequence of the presence of a multitude of edge surfaces in the polypropylene material which makes up the warp and weft 13 and 14 as a result of the fibrillation of the warp and weft tapes during the passage of the woven fabric 1 through the fibrillating apparatus 3.

Accordingly, the woven fabric of FIG. 5, in which the warp and weft 13 and 14 are broken down so that each warp or weft is essentially a flat bundle of fibrils, is a backing material for use in the manufacture of tufted carpets which may be employed successfully to reduce the incidence of grinning.

However, the woven fabric of FIG. 5 which presents a large number of edge surfaces to the fibrils in the warp and weft 13 and 14 is also found to be capable of coloration by dyeing if the woven fabric is made from a dyeable synthetic resinous material such as a polyester, a polyamide, a polyacrylonitrile, a polyvinyl alcohol, a polyvinyl chloride, a cellulose acetate or a viscose material. The woven fabric which is the product of FIG. 5 is also dyeable when made of a generally non-dyeable synthetic resinous material if a dyeable component is incorporated in the generally non-dyeable synthetic resinous material, such as polypropylene, before this material is extruded and formed into tapes, woven into a fabric and then fibrillated.

FIG. 7 illustrates a flow diagram for carrying out this process. It has been found that, when a disperse dyeing agent is included in the polypropylene from which the woven fabric is made, the woven fabric which is the product of FIG. 5 is dyeable to a good coloration—markedly better than the coloration obtained when a woven fabric made from the same polypropylene and disperse dyeing agent is dyed when in the form of the product of FIG. 4. The product of FIG. 4 takes up some color but not a great deal; the coloration of the product of FIG. 4 has not been adequate for many uses of the woven fabric, including its use as a primary carpet backing.

Another method of applying coloration to the woven fabric 1, the warp and weft components of which are fibrillated using the fibrillating apparatus 3, is by adding pigment to the synthetic resinous material (for example polypropylene) when this material is extruded. Such a pigmented woven fabric, when fibrillated to produce the product of FIG. 5, has particular use as a furnishing fabric or a wall fabric as a result of the matt finish which is much preferable to the shiny finish.

As already indicated, a woven fabric 1, in accordance with the present invention and as illustrated in FIG. 5, has substantial advantages when used as a primary backing for tufted fabric. One of the most significant advantages is a substantial improvement in the overcoming of the defect known as needle deflection, which will be discussed further in relation to the products of FIGS. 4 and 5.

In the woven fabric of FIG. 4, there tend to be spaces between the warp tapes 11 and the weft tapes 12 so that there are four possibilities facing the tufting needle which strikes the woven fabric of FIG. 4. The tufting needle may strike a warp tape 11 in a position where it is unsupported by a weft tape 12, or it may strike a weft tape 12 in a position where the weft tape is unsupported by a warp tape 11, or it may strike the woven fabric at a position where the warp and weft tapes 11 and 12 are supporting one another, or it may strike the woven fabric at a position where there is a gap between the edges of a warp tape 11 and a weft tape 12. In consequence of this considerable variation in the possibility facing the tufting needle, the tufting yarn which is secured to the woven fabric of FIG. 4 in a tufting operation will have an uneven pile surface.

In the woven fabric of FIG. 5, the warp and weft have been broken down into a multiplicity of fibrils and are less liable to needle deflection since the needle has a much greater chance of striking into a gap between fibrils. In consequence, the woven fabric of FIG. 5 presents less variety to the tufting needle than the woven fabric of FIG. 4 and gives a more level pile surface to the final tufted carpet than that obtained by the tufted carpet produced from the conventional woven fabric of FIG. 4.

Because of the substantial decrease in the reflectivity of the surfaces of the warp and weft components which make up the woven fabric as a result of the treatment in accordance with the present invention, the woven fabric of FIG. 5 is a more acceptable form of backing material for tufted carpets.

When the woven fabric of FIG. 5 is tufted in order to produce a tufted carpet, it provides a more regular and consistent spacing of the tuft lines than is obtained by tufting the woven fabric of FIG. 4. This is because the surface of the woven fabric of FIG. 5 is a relatively good acceptor of the tufting needle in the sense that, wherever the tufting needle strikes the surface of the woven fabric of FIG. 5, it will be able to penetrate between adjacent fibrils without causing any significant needle deflection. The tufts of yarn will thus be located at substantially the places where the tufting needles strike the surfaces of the woven fabric. By contrast, the woven fabric of FIG. 4 is not a good acceptor of the tufting needle because the tufting needle must itself break through the surface of a warp tape 11 or a weft tape 12, and in some cases (particularly near the edges of the warp and weft tapes) the tufting needle will fail to do this, but will deflect the warp or weft tapes to one side so that there will be an uneven spacing between that particular tuft of yarn and the adjacent tuft.

When a woven fabric which is intended for use as a carpet backing is fibrillated in accordance with the present invention, the fibrillating treatment may be applied to the main central part of the woven fabric but strips down the opposite edge portions of the woven fabric may be left untreated. The purpose of leaving edge portions of the woven fabric untreated is to retain in those edge portions good properties for enabling the woven fabric to be mechanically pinned during later treatment, the untreated portions being eventually trimmed from the woven fabric before the final carpet product is rolled.

The fibrillation of the tapes in a woven fabric of synthetic resinous material such as polypropylene using the fibrillating apparatus 3 as hereinbefore described is not to be confused with the known process of "tip-needling" such a woven fabric. In a tip-needling process, the woven fabric is passed through a needle loom similar to that used to needle an overlay of fibres to the woven fabric before tufting, as described earlier, but without introducing any fibres. Only the tips of the needles are caused to pierce the tapes in the woven fabric, the barbs on the needles kept clear of the surfaces of the tapes. The purpose of tip-needling was to try to break-up the tapes in order to allow for more precise acceptance of the tufting needle and thus reduce the incidence of needle deflection, but in practice the use of tip-needling has increased the expense in producing the woven carpet backing without even being entirely successful in eliminating needle deflection. Furthermore, the surfaces of the carpet backings after treatment in a tip-needling process have retained their sheen and it has proved difficult to distinguish a tip-needled backing from one which has not been subjected to this treatment.

It is thought that there are two main reasons why the known tip-needling process has not produced the advantageous results provided in accordance with the present invention. Firstly, the tip-needling has been carried out with needles which have a triangular section. Secondly, the density of the perforations effected in a tip-needling process has been of an order of only 50 to 100 (usually about 80) penetrations per square centimeter which is a quite different order from that employed in the process of the present invention which, as previously stated, is at least 800 per square centimeter and preferably at least 1,800 per square centimeter.

Another significant difference between the fibrillating apparatus as described in the present specification and the known needle loom is the nature of the support for the fabric while it is being treated by the needles of the fibrillating apparatus. In accordance with the present invention, the base support, e.g. chromed leather, provides a close support against the back surface of the woven fabric, so that the fabric is effectively supported, but at the same time the support material is able to accommodate the tips of the needles without damage to the needles of the fibrillating apparatus. The support which onsists of a metal plate which has provided a hole or slot to accept each of the needles. The complexity of providing such a metal plate in a fibrillating apparatus according to the present invention is enormous and thought to be impractical.

In order to facilitate the penetration of the needles without displacement of the woven fabric, it has been found advantageous to retain the fabric under substantial tension during the needling operation.

In the preferred operation of the apparatus of the present invention with the needles of the shape illustrated in FIG. 3 of the accompanying drawings, the needles are caused to pierce the fabric but not to extend any substantial distance beyond the supported rear surface of the woven fabric. The tips of the needles generally extend anything from about 0.5 millimeters to approximately 3 millimeters beyond the rear surface of the woven fabric, and the action of all the needles on the fabric should be similar. Such substantial uniformity in the effect of the needles on the woven fabric is obtained by accurate mounting of the needles in the needle board so that the tips of all the needles are caused to lie substantially in the same plane, and by providing the support for the rear surface of the woven fabric, which support is close and effectively continuous but penetrable by the needles without damage to them.

It will be appreciated that the arrangement of the fibrillating apparatus illustrated in FIGS. 1 to 3 of the accompanying drawings is a preferred apparatus. While it is most convenient for the needle board to be mounted above the woven fabric, which in turn is above the support which is the leather, other arrangements are possible. For example, the woven fabric could be tensioned over the needle board which has the needles pointing upwardly and with the support for the woven fabric above the woven fabric. Alternatively, the fabric could be advanced in a vertical plane between the support and the needles of the fibrillating apparatus.

It is only by the practice of the present invention that the tapes which comprise the warp and weft components of the woven fabric have been really reduced to a multiplicity of fibrils while being relatively free of surface hairiness. These features provide the marked improvements in reduction in sheen, enhanced adherability, improved ability to impart color, and reduction in needle deflection which have been described herein.

I claim:

1. A method of manufacturing a matt surfaced woven fabric having warp and weft of synthetic resinous material, each warp and weft being substantially totally fibrillated and comprising a flat bundle of fibrils, substantially all the fibrils in each warp and weft being joined together in the form of a random network and the surface of the woven fabric being substantially free of surface hairiness, which includes the step, after weaving a woven fabric having warp and weft tapes of synthetic resinous material, of substantially totally fibrillating the warp and weft tapes by repeated needling to subject each square centimeter thereof to at least 800 needle penetrations using smooth needles of rounded cross-section so that the warp and weft tapes are each broken down into a multiplicity of fibrils which are joined together in the form of a random network, the fibrillated fabric having warp and weft each of which comprises a flat bundle of fibrils and the fibrillated woven fabric being substantially free of surface hairiness.

2. A method in accordance with claim 1 wherein the number of needle penetrations is at least 1,800 per square centimeter.

3. A method in accordance with claim 1 wherein the needle is repeated until a majority of the fibrils include portions of non-rectangular cross-section.

4. A method in accordance with claim 1 wherein the needling is effected using needles of circular cross-section.

5. A method in accordance with claim 1 wherein a dyeable component is included in the synthetic resinous material.

6. A method in accordance with claim 1 which further includes the step of adhering a coating material to the fibrillated woven fabric.

7. A method in accordance with claim 1 which further includes the step of adhering a dyeable coating material to the fibrillated woven fabric.

8. A method in accordance with claim 7 which further includes the step of adhering an acid-dyeable resin to the fibrillated woven fabric.

9. A method of making a carpet comprising the step of tufting with pile yarns a woven fabric manufactured by a method in accordance with claim 1.

* * * * *

UNITED STATES PATENT AND TRADEMARK OFFICE

CERTIFICATE OF CORRECTION

PATENT NO. : 4,156,957

DATED : June 5, 1979

INVENTOR(S) : Alexander D. D. McKay

It is certified that error appears in the above-identified patent and that said Letters Patent are hereby corrected as shown below:

Column 3, line 64, amend the first wood "These" to read "There".

Column 5, line 40, correct the spelling of "millimetres".

Column 12, line 9, after "needles" insert "being".

Claim 3, line 2, amend the first wood "needle" to read "needling".

Signed and Sealed this

*Twelfth* Day of *February 1980*

[SEAL]

*Attest:*

SIDNEY A. DIAMOND

*Attesting Officer*

*Commissioner of Patents and Trademarks*